US011702913B2

(12) United States Patent
Shaw

(10) Patent No.: US 11,702,913 B2
(45) Date of Patent: Jul. 18, 2023

(54) WELLBORE SYSTEM HAVING AN ANNULUS SAFETY VALVE

(71) Applicant: Silverwell Technology Ltd., Histon (GB)

(72) Inventor: Joel David Shaw, Houston, TX (US)

(73) Assignee: SILVERWELL TECHNOLOGY LTD., Cambridgeshire (GB)

( * ) Notice: Subject to any disclaimer, the term of this patent is extended or adjusted under 35 U.S.C. 154(b) by 162 days.

(21) Appl. No.: 17/232,737

(22) Filed: Apr. 16, 2021

(65) Prior Publication Data

US 2022/0333469 A1 Oct. 20, 2022

(51) Int. Cl.

| | |
|---|---|
| ***E21B 43/12*** | (2006.01) |
| ***E21B 34/08*** | (2006.01) |
| ***E21B 34/14*** | (2006.01) |

(52) U.S. Cl.

CPC ..... *E21B 43/1235* (2020.05); *E21B 34/08* (2013.01); *E21B 34/14* (2013.01); *E21B 2200/02* (2020.05)

(58) Field of Classification Search

CPC ..... E21B 34/08; E21B 34/066; E21B 34/14; E21B 34/124; E21B 43/122; E21B 43/123; E21B 43/1235

See application file for complete search history.

(56) References Cited

U.S. PATENT DOCUMENTS

| | | | | |
|---|---|---|---|---|
| 3,016,844 | A | 1/1962 | Vincent | |
| 3,754,597 | A | 8/1973 | Garrett | |
| 6,705,404 | B2 | 3/2004 | Bosley | |
| 6,715,550 | B2 | 4/2004 | Vinegar et al. | |
| 6,758,277 | B2 | 7/2004 | Vinegar et al. | |
| 7,896,082 | B2 | 3/2011 | Lake et al. | |
| 9,416,621 | B2 | 8/2016 | Mackenzie et al. | |
| 10,294,763 | B2 | 5/2019 | Kleppa | |
| 2003/0141073 | A1* | 7/2003 | Kelley | E21B 43/305 166/372 |
| 2006/0278395 | A1 | 12/2006 | Kenison et al. | |
| 2011/0083855 | A1* | 4/2011 | Wygnanski | E21B 43/123 166/334.4 |
| 2020/0032627 | A1 | 1/2020 | Salihbegovic et al. | |

OTHER PUBLICATIONS

UK Search Report dated Sep. 22, 2022, Application No. GB2205370.6.

* cited by examiner

*Primary Examiner* — Kristyn A Hall
(74) *Attorney, Agent, or Firm* — Bracewell LLP; Constance G. Rhebergen; Keith R. Derrington

(57) ABSTRACT

An annulus safety valve assembly for controlling gas flow in a wellbore annulus that includes a passage, a check valve in the passage, and an actuator that is selectively changed between first and second states. The actuator is bi-stable, and requires no energy to remain in either state. When the actuator is put into one of the states, the check valve configuration is changed from one way flow to two way flow. Reconfiguring the check valve into the two way flow configuration vents lift gas from inside the annulus that is below the check valve.

12 Claims, 5 Drawing Sheets

10
26
28
30
32
21
46
50
58
48
60
56
57
54
36
34
38
52
40
A
$42_1$
62
30
$42_2$
12
$42_3$
18
24
$42_4$
$42_n$
20
44
22
14
16
L
G
F

WELLBORE SYSTEM HAVING AN ANNULUS SAFETY VALVE

BACKGROUND OF THE INVENTION

1. Field of Invention

The present disclosure relates to a safety valve that controls fluid flow in an annulus, and that is selectively changeable between a one way valve and a two way valve.

2. Description of Prior Art

Lift systems for unloading liquids from a well include pumps, such as electrical submersible pumps ("ESP"), which pressurize the liquid downhole and propel it up production tubing that carries the pressurized fluid to surface. Sucker rods and plunger lift pumps are also sometimes employed for lifting liquid from a well. In wells having an appreciable amount of gas mixed with the liquid a two-phase fluid may form and gas is sometimes separated from the fluid upstream of the ESP and routed to surface separately from the pressurized liquid. In some instances compressor pumps are employed to pressurize the two-phase fluid to lift it to surface. A gas lift system is another type of artificial lift system, and that injects a lift gas, typically from surface, into production tubing installed in the well. The lift gas is usually directed into an annulus between the production tubing and sidewalls of the well, and from the annulus into the production tubing. Gas lift is commonly employed when pressure in a formation surrounding the well is insufficient to urge fluids to surface that are inside of the production tubing. By injecting a sufficient amount of lift gas into the production tubing, static head pressure of fluid inside the production tubing is reduced to below the pressure in the formation, so that the formation pressure is sufficient to push the fluids inside the production tubing to surface. Fluids that are usually in the production tubing are hydrocarbon liquids and gases produced from the surrounding formation. Sometimes these fluids are a result of forming the well or a workover, and have been directed into the production tubing from the annulus.

The lift gas is typically transported to the well through a piping circuit on surface that connects a source of the lift gas to a wellhead assembly mounted over the well. To avoid an escape of the pressurized lift gas in the well should there be a breach of lift gas containment on surface, safety valves are occasionally installed in the well that arrest lift gas release from the well. Sometimes the lift gas in the well is vented through these safety valves to reduce well pressure, such as in the case of workovers or other well operations.

SUMMARY OF THE INVENTION

Disclosed herein is a system for use with a wellbore that includes an annulus defined between tubulars disposed in the wellbore, and an annulus safety valve disposed in the annulus that is made up of a body, a bistable actuator selectively changeable between deployed and retracted operational states, and a check valve that is selectively changeable between an open position and a closed position, and that is maintained in the open position when the bistable actuator is in the deployed operational state. The actuator optionally includes an electrically powered motor and a shaft coupled with the motor. In this example the shaft is spaced away from the check valve when the actuator is in the retracted operational state, and the shaft is positioned in interfering contact with the check valve when the actuator is in the deployed operational state. Also in this example the check valve includes a valve member, a valve seat, and a spring biasing the valve member against the seat. In an alternative, when the shaft is in interfering contact with the check valve assembly, the valve member is spaced away from the valve seat to define a path for fluid flow between the valve seat and the valve member. Ports are optionally formed through the valve member, and wherein the path extends through the ports. In one embodiment, the annulus has upper and lower portions that are adjacent one another, and wherein the upper and lower portions are in communication when the check valve is the open position, and wherein the upper and lower portions are isolated from one another when the check valve is in the closed position. The check valve is alternatively disposed in a passage that is formed through the body, and wherein opposing terminal ends of the passage are respectively in communication with the upper and lower portions. In an embodiment, the check valve is moved into the open position when pressure in the upper portion exceeds pressure in the lower portion by a designated amount. The actuator is optionally in communication with an electrical source when changing to the deployed configuration, and wherein the actuator is out of communication with the electrical source while remaining in the deployed configuration. Examples of the tubulars include casing lining the wellbore and production tubing inside the casing, in an embodiment the system further includes a wellhead assembly mounted over an opening to the wellbore, a source of lift gas in communication with the annulus through the wellhead assembly, wherein lift gas is selectively injected into the tubing through lift gas valves that are coupled to the tubing. In this example lift gas flows through the check valve when the check valve is in the open position.

Also disclosed is a method of operating a wellbore which includes handling lift gas in an annulus of the wellbore in which an annulus safety valve is disposed; in this example the annulus safety valve includes a body, a passage in the body, a check valve in the passage, and an actuator. The example method further includes venting from the wellbore by providing a supply of electricity to the actuator to change the actuator from a retracted configuration to a deployed configuration which biases the check valve into an open position, removing the supply of electricity to the actuator, and maintaining the actuator in the deployed configuration while the actuator is isolated from a power source. The method optionally includes injecting lift gas into the wellbore at a pressure which maintains the check valve in the open position and lift gas flows from uphole of the check valve to downhole of the check valve. In an example, the check valve includes a spring and a valve member, and wherein the spring biases the valve member against a valve seat to automatically put the check valve into a closed position when pressure downhole of the check valve exceeds pressure uphole of the check valve. In an embodiment, the actuator is reconfigured from the deployed operational configuration to the retracted operational configuration by energizing the actuator. In an example, venting involves removing lift gas from the wellbore.

BRIEF DESCRIPTION OF DRAWINGS

Some of the features and benefits of the present invention having been stated, others will become apparent as the description proceeds when taken in conjunction with the accompanying drawings, in which.

Figure 1:
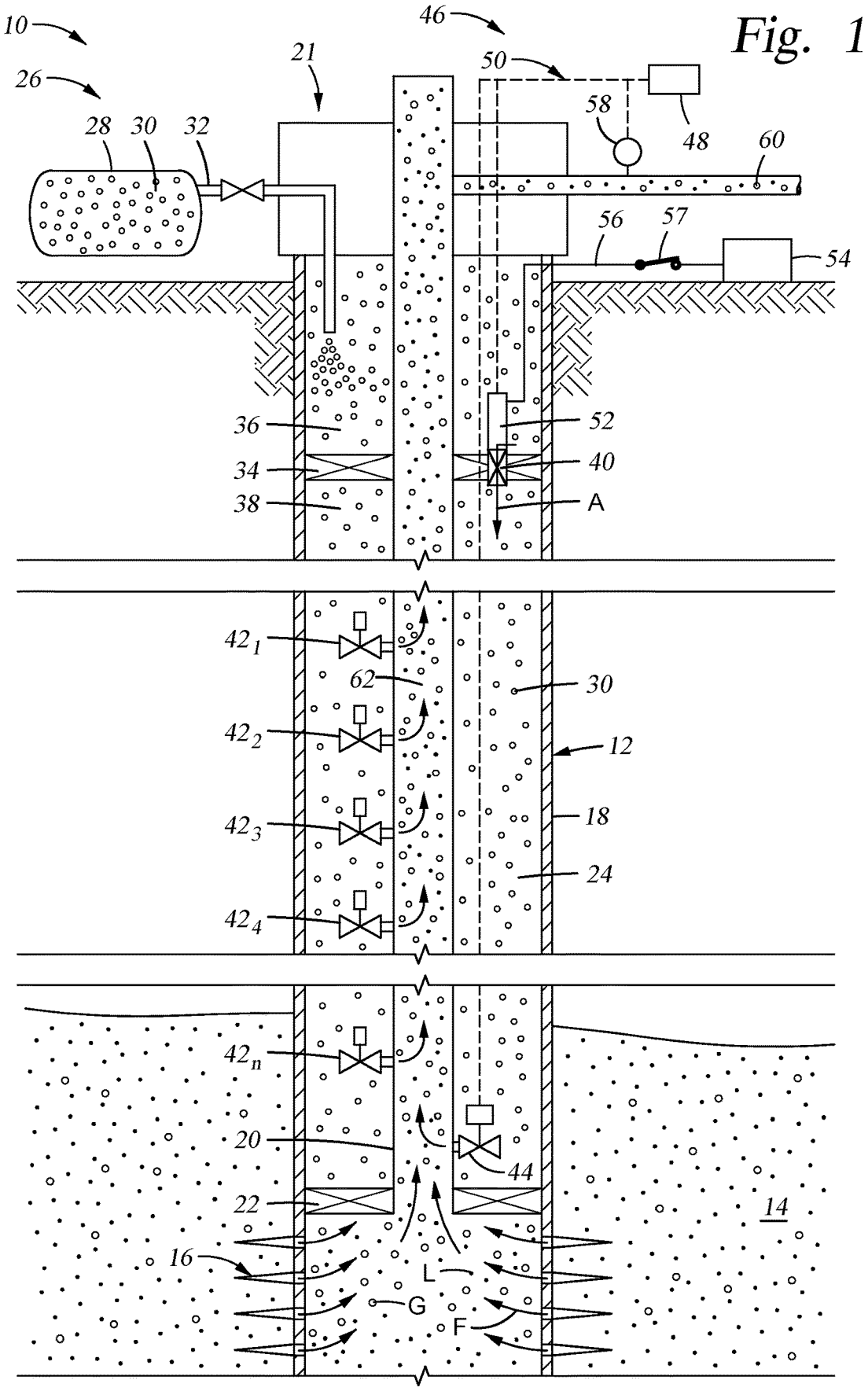
FIG. 1 is a side partial sectional view of an example of injecting lift gas into a well.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side partial sectional view in FIG. 1 is an example of a well system 10 for use in producing fluid F that has entered a wellbore 12 from a surrounding formation 14. In the example shown fluid F includes liquid L and gas G, alternatively fluid F is made up of substantially all liquid L or gas G; and in an example fluid F includes hydrocarbons. Perforations 16 are illustrated that project radially outward from wellbore 12, through casing 18 lining the wellbore 12, and into formation 14; the perforations 16 provide a pathway for the fluid F to enter the wellbore 12 from the formation 14. Production tubing 20 is shown installed within casing 18, a lower end of tubing 20 is in communication with the fluid F. On an opposite end production tubing 20 connects to a wellhead assembly 21 shown mounted on surface and at the opening to wellbore 12. A lower packer 22 is shown formed in an annulus 24 that is defined in the annular space between tubing 20 and casing 18.

Included with the well system 10 of FIG. 1 is a lift gas system 26, which in the illustrated example includes a lift gas source 28; examples of the lift gas source 28 include adjoining wells (not shown), vessels, and transmission lines. Lift gas 30 is shown within lift gas source 28 and a line 32 attaches to lift gas source 28 provides a means for transmitting lift gas 30 into wellbore 12. In the example shown, line 32 is schematically represented penetrating a side of well assembly 21 and which directs lift gas 30 into communication with annulus 24. An upper packer 34 is depicted in annulus 24 downhole from a terminal end of line 32 and uphole than lower packer 22. For the purposes of discussion herein, downhole refers to locations in the wellbore 12 or formation 14 that are at a greater depth or deeper than the referenced location or element, and uphole refers to locations in the wellbore 12 or formation that are at a lesser depth than the referenced location or element. A section of the annulus 24 between upper packer 34 and wellhead assembly 21 is referred to as an upper portion 36, and the section of the annulus 24 between upper packer 34 and lower packer 22 is referred to as the lower portion 38; as shown portions 36, 38 are adjacent one another. Upper packer 34 operates as a barrier to fluid communication between the upper and lower portions 36, 38 and isolates the portions 36, 38 from one another. An annulus safety valve 40 is shown formed through packer 34 and as explained in more detail below, provides selective fluid communication between the upper and lower portions 36, 38. Further shown in the example of FIG. 1 are lift gas valves $\mathbf{42}_{1\text{-}4}$, lift gas valve $\mathbf{42}_n$, and lift gas valve 44. In the illustrated embodiment lift gas valves $\mathbf{42}_{1\text{-}4}$ and lift gas valve $\mathbf{42}_n$, are pressure operated lift gas valves, and lift gas valve 44 is a surface operated valve. Specifically, lift gas valves $\mathbf{42}_{1\text{-}4}$ and lift gas valve $\mathbf{42}_n$ change between open and closed positions based upon pressure in either the annulus 24 or within the tubing 20; whereas lift gas valve 44 is remotely actuated between open and closed positions. An example of a surface controlled valve 44 is described in Wygnanski, U.S. Pat. No. 8,925,638, and which is incorporated by reference herein its entirety and for all purposes. In alternatives all of lift gas valves $\mathbf{42}_{1\text{-}4}$ and lift gas valve $\mathbf{42}_n$, and lift gas valve 44 are pressure operated, or all are surface controlled. When in the open position, lift gas valves $\mathbf{42}_{1\text{-}4}$ and lift gas valve $\mathbf{42}_n$ and lift gas valve 44 selectively provide communication between annulus 24 and to the inside of tubing 20; and with the injection of higher pressure lift gas 30 into the annulus 24, the lift gas 30 is injected into the tubing 20 through the open valves $\mathbf{42}_{1\text{-}4}$, $\mathbf{42}_n$ 44.

A control system 46 is schematically shown as a part of the well System 10 of FIG. 1, and which includes a controller 48 in communication with other devices or to remote locations via a communications link 50, examples of communication link are hard wired, pneumatic, wireless, and fiber optic, as well as other known and further developed means of communicating signals. Examples of controller 48 include a readable medium with programmed instructions for delivering instructions for operation of the well system 10. In an example controller 48 is an information handling system ("IHS") and controls the generation of the signals herein described as well as receiving signal and/or generating and transmitting commands in response to receiving signals; such as from within wellbore 12 or remotely. In an alternative, the IHS stores recorded data as well as processing the data into a readable format. The IHS is optionally disposed at the surface, in the wellbore 12, or partially above and below the surface. In embodiments, the IHS includes a processor, memory accessible by the processor, nonvolatile storage area accessible by the processor, and logics for performing each of the steps described herein. In the example of FIG. 1 communication link 50 provides communication between lift gas valve 44 and controller 50, as well as between controller 48 and an actuator 52 for use with the annulus safety valve 40. In the illustrated example actuator 52 is in electrical communication with a power source 54 shown on surface and connected to actuator 52 by a cable 56. In an alternative, actuator 52 is energized by power delivered from controller 48 through communication link 50. A switch 57 is schematically illustrated with cable 56, which in examples provides for selective power communication and termination between power source 54 and actuator 52. A sensor 58 is optionally provided on a production line 60 shown connected to wellhead assembly 21 and that transports fluid F produced from wellbore 12 to locations that are off-site from the well system 10. In examples, sensor 58 monitors one or more of pressure, temperature, fluid properties in line 60, and fluid flow rate in line 60. Additional sensors (not shown) are optionally included that are in one or more of the annulus 24, tubing 20, and line 32. A sensor in line 32 alternatively provides a flow rate of lift gas 30.

In a non-limiting example of operation of the well system 10, the lift gas 30 is injected into the upper portion 36 of annulus 24 and flows through the annulus safety valve 40 and further downhole inside lower portion 38. As described in more detail below, annulus safety valve 40 is configured to automatically open in response to a differential pressure across the annulus safety valve 40 that occurs when pressure in the upper portion 36 exceeds pressure in the lower portion 38, and in some instances the differential pressure is a designated amount adequate to operate mechanisms inside the annulus safety valve 40. In this example, the annulus safety valve 40 remains open during the time the differential pressure is present. When the annulus safety valve 40 is open in response to the differential pressure the direction of lift gas 30 flow is illustrated by arrow A of FIG. 1. As shown, the injected lift gas flows through the annulus safety valve 40 and downhole within annulus 24 to the lift gas valves $\mathbf{42}_{1\text{-}4}$, lift gas valve $\mathbf{42}_{n}$, and lift gas valve 44. Lift gas 30 enters production tubing 20 via one or more of the lift gas valves $\mathbf{42}_{1\text{-}4}$, lift gas valve $\mathbf{42}_{n}$, and/or lift gas valve 44. Once inside the production tubing 20 the lift gas 30 forms lift gas bubbles 62 that lower the density of the liquid L portion of the fluid F inside the wellbore 12 to facilitate lifting the produced fluid F to the wellhead assembly 21 where it is routed into the production line 60. Conversely, the annulus safety valve 40 is configured to automatically close when pressure in the lower portion 38 exceeds that in the upper portion 36; and remains closed when pressure in the lower portion 38 is greater than the upper portion 36.

Figure 2:
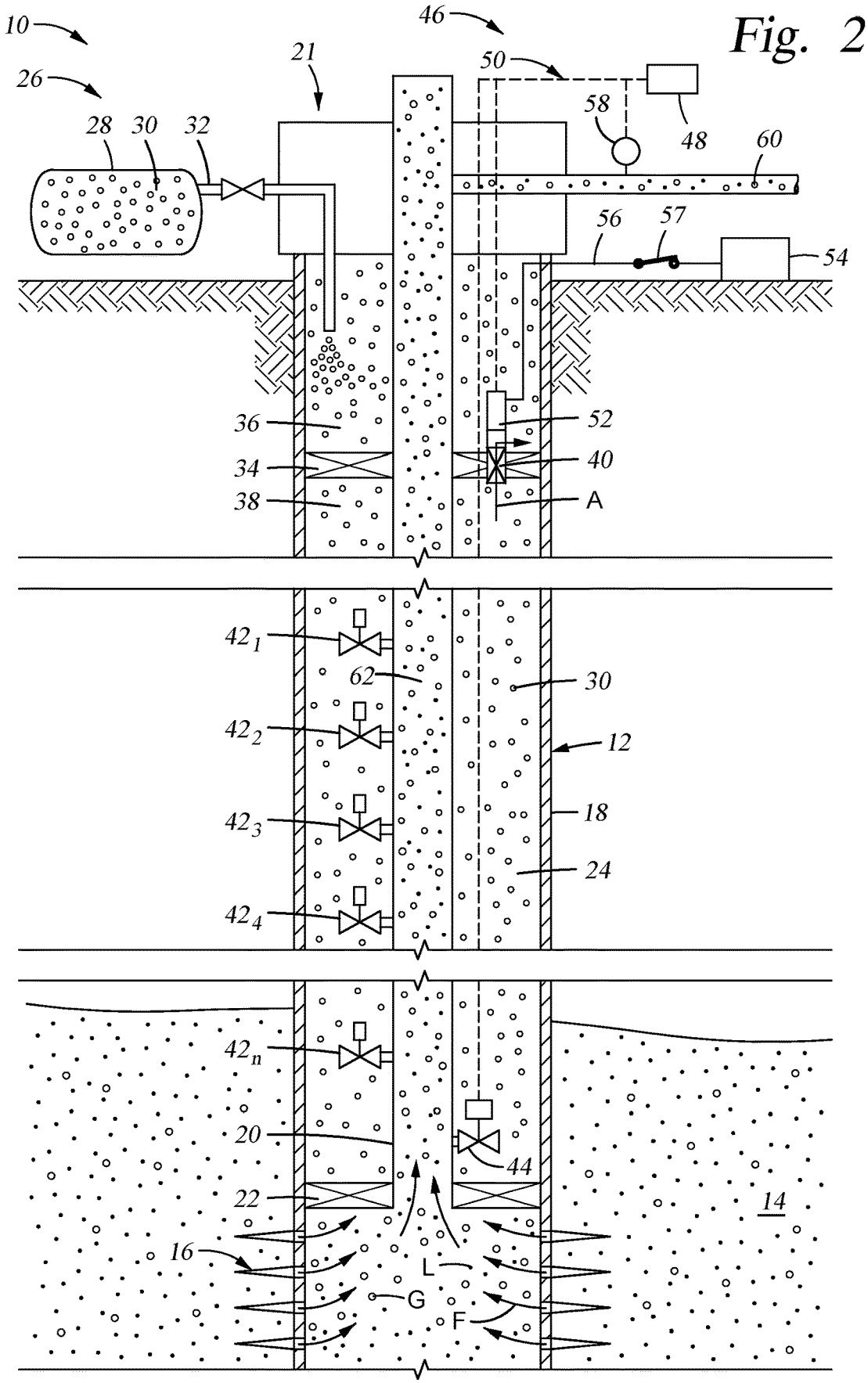
FIG. 2 is a side partial sectional view of an example of venting lift gas from the annulus of FIG. 1.

Referring now to FIG. 2, an example of venting lift gas 30 from the annulus is shown, which in some examples occurs during a workover of the wellbore 12, or in an emergency situation when it is needed to reduce pressure within the wellbore 12. In this example, automatic features of the annulus safety valve 40 are overridden and the annulus safety valve 40 is put into and maintained in an open position. In alternatives to this example, the annulus safety valve 40 is maintained in the open position irrespective if the pressure in the upper portion 36 exceeds pressure in the lower portion 38, or if pressure in the upper portion 36 is exceeded by pressure in the lower portion 38. In examples when pressure in the lower annulus 38 exceeds pressure in the upper annulus 36, lift gas 30 (or other fluids in the lower annulus 38) flows through annulus safety valve 40 and in the direction illustrated by arrow A of FIG. 2, i.e. uphole from lower portion 38 to upper portion 36. In an example lift gas 30 (or other fluid) flowing uphole through annulus safety valve 40 enters line 32 and is directed to the lift gas source 30. Other operational examples exist in which the lift gas 30 flowing uphole through the annulus safety valve 40 is directed into the production line 60 or other lines (not shown) that are connected with the wellhead assembly 21. In an alternative, a manifold (not shown) within wellhead assembly 21 provides a way for routing the lift gas 30 from within production tubing 20 and into line 60 or other lines. Examples of this step of venting include controlling operation of the actuator 52 by instructions generated by or sent to controller 48 that are then transmitted downhole through the communication means 50. In a non-limiting example, actuator 52 is a bistable actuator that is changed between a retracted configuration (that does not interfere with the automatic opening and closing of annulus safety valve 40) and a deployed configuration (that maintains the annulus safety valve 40 in an open position) by directing electricity to the actuator 52 from power source 54. Further, in this example, the bistable nature of actuator 52 allows that the supply of electricity or electrical power from power source 54 to actuator 52 be terminated while the actuator 52 is in the deployed or the retracted configuration so that the constant supply of power is not required to maintain a particular operational configuration of actuator 52. In an alternative, power is resumed from power source 54 to the actuator 52 when it is desired or planned to reconfigure actuator 52 between its deployed and retracted configurations. In an embodiment, switch 57 is toggled from an open position to a closed position so that power from power source 54 is communicated to actuator 52 for reconfiguring actuator 52 from the deployed operational state or configuration into a retracted operational state or configuration. Further in this example, when actuator 52 is in the retracted operational state or configuration annulus safety valve 40 operates automatically as described above.

Figure 3:
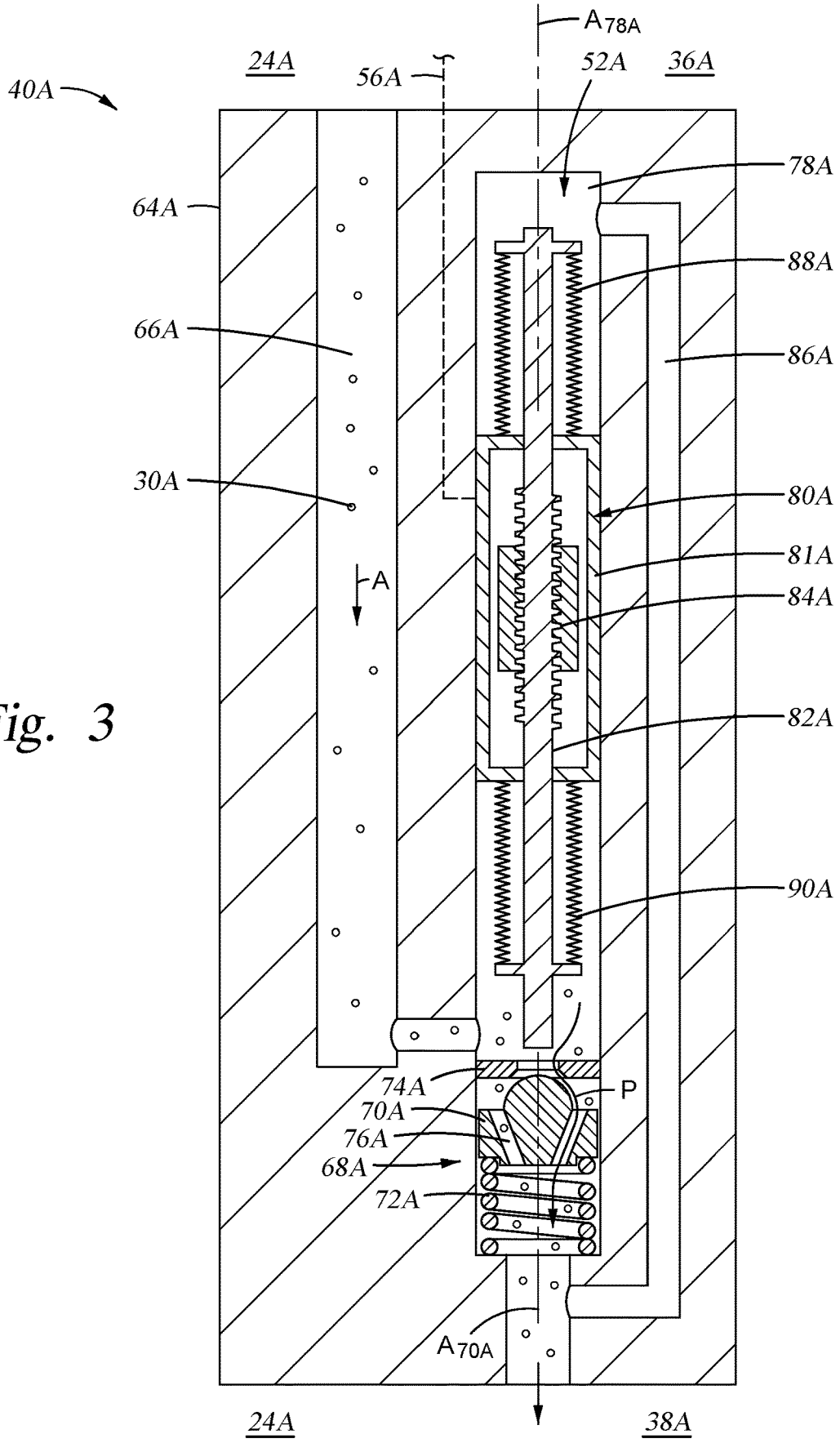
FIG. 3 is a side partial sectional view of an example of an annulus safety valve for use with the well of FIG. 1 and in a flow open position.

A schematic example of the annulus safety valve 40 is shown in a side sectional view in FIG. 3. In this example, valve 40A is shown having a body 64A and through which a passage 66A is formed; opposing ends of passage 66A are respectively in communication with upper portion 36A of annulus 24A and lower portion 38A of annulus 24A. Exposed within a portion of passage 66A, is a check valve assembly 68A that as described below automatically controls a flow of fluid through passage 66 in response to respective pressure values in the upper and lower portions 36A, 38A. Check valve assembly 68A includes a valve member 70A which is shown biased by a spring 72A towards a valve seat 74A. In the example shown, a differential pressure is created across the annulus safety valve 40A by pressure in the upper portion 36A exceeding pressure in the lower portion 38A. The differential pressure automatically opens the annulus safety valve 40A by generating a force on the check valve assembly 68A sufficient to compress the spring 72A and to urge the valve member 70A away from the valve seat 74A; which produces a gap between the valve member 70A and valve seat 74A. The presence of the gap in combination with the pressure differential, forces the lift gas 30A from the upper portion 36A to the lower portion 38A through the passage 66A. As shown, a path P is formed by spacing the valve member 70A away from the valve seat 74A, the path P further extends through ports 76A shown formed axially through the valve member 70A. The lift gas 30A is directed along the path P when flowing across the check valve assembly 68A. Past the valve member 70, the lift gas 30A makes its way to the lower portion 38A via passage 66. In an example, the annulus safety valve 40A of FIG. 3 is in an automatically open position to provide communication between the upper and lower portions 36A, 38A. Illustrated in FIG. 3 is that the axis $A_{70A}$ of valve member 70A is aligned with axis $A_{78A}$ of chamber 78A, in alternatives these axes are offset from one another.

The actuator 52A embodiment of FIG. 3 is disposed in a chamber 78A formed within body 64A, a portion of chamber 78A adjacent the check valve assembly 68A is in communication with passage 66A. Actuator 52A of FIG. 3 includes a motor 80A having an outer housing 81A, and an elongated shaft 82A that intersects the housing 81A and couples to components within the motor 80A. Example ways for coupling motor 80A and shaft 82A include gears 84A, which are schematically represented as worm gears, in alternatives different types of gears are used for coupling the motor 80 in shaft 82A. Coupling between motor 80A and shaft 82A is alternatively via an electromagnetic force. Motor 52A of FIG. 3 is in a retracted configuration with the shaft 82A spaced away from the check valve assembly 68A.

Figure 4:
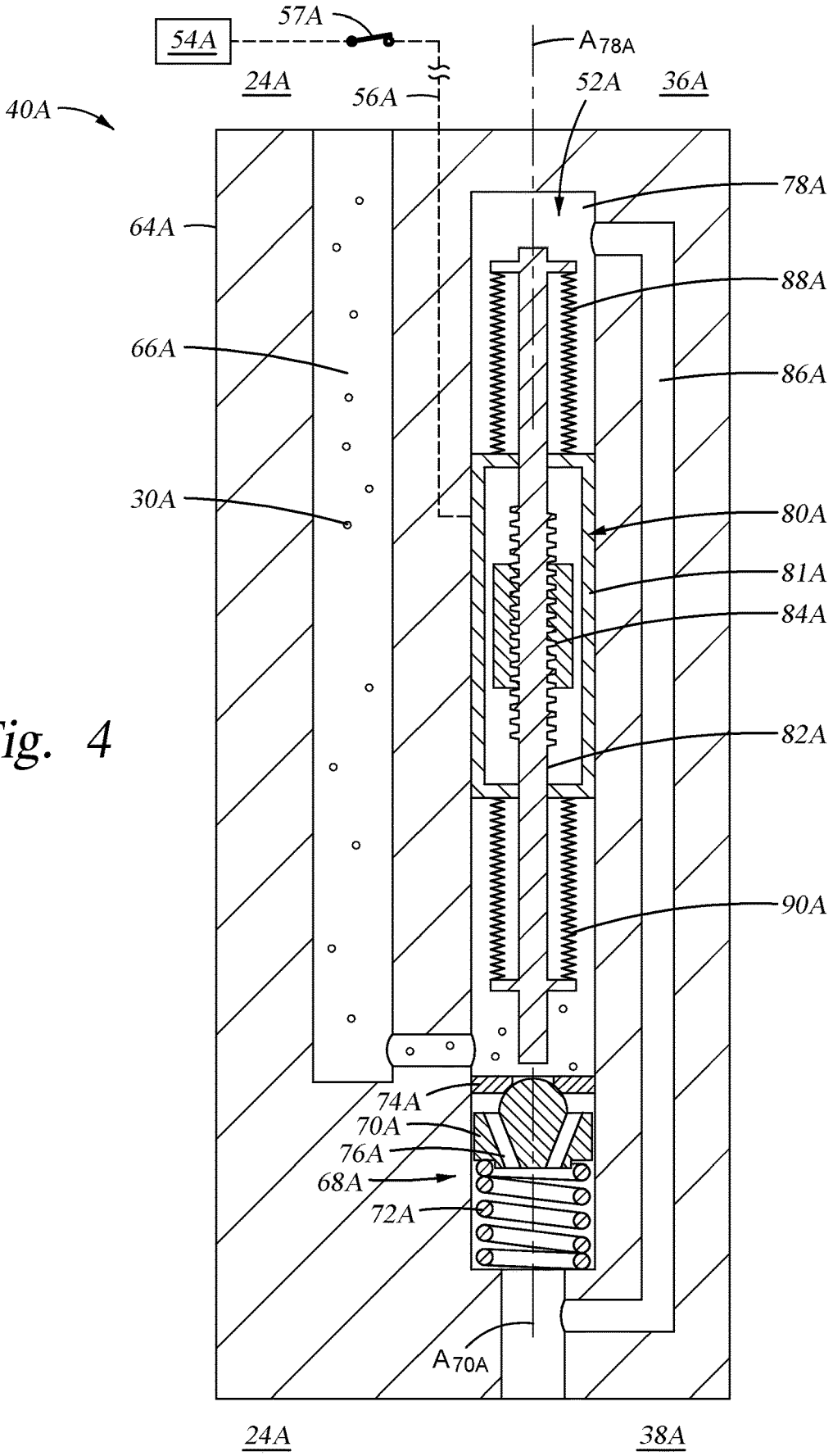
FIG. 4 is a side partial sectional view of an example of an annulus safety valve for use with the well of FIG. 1 and in a flow closed position.

Referring now to FIG. 4, in the example shown the pressure of the lower portion 38A is at least close enough to the pressure in the upper portion 36A so that the biasing force of the spring 72A overcomes the force generated on the valve member 70A by the pressure differential and urges the valve member 70A into contact with the valve seat 74A. Contacting the valve member 70A and valve seat 74A as shown puts in check valve assembly 68A in its closed position, and which blocks fluid flow from lower portion 38A into passage 66A and isolates upper and lower portions 36A, 38A from one another. In an example, the annulus safety valve 40A of FIG. 4 is in an automatically closed position.

Figure 5:
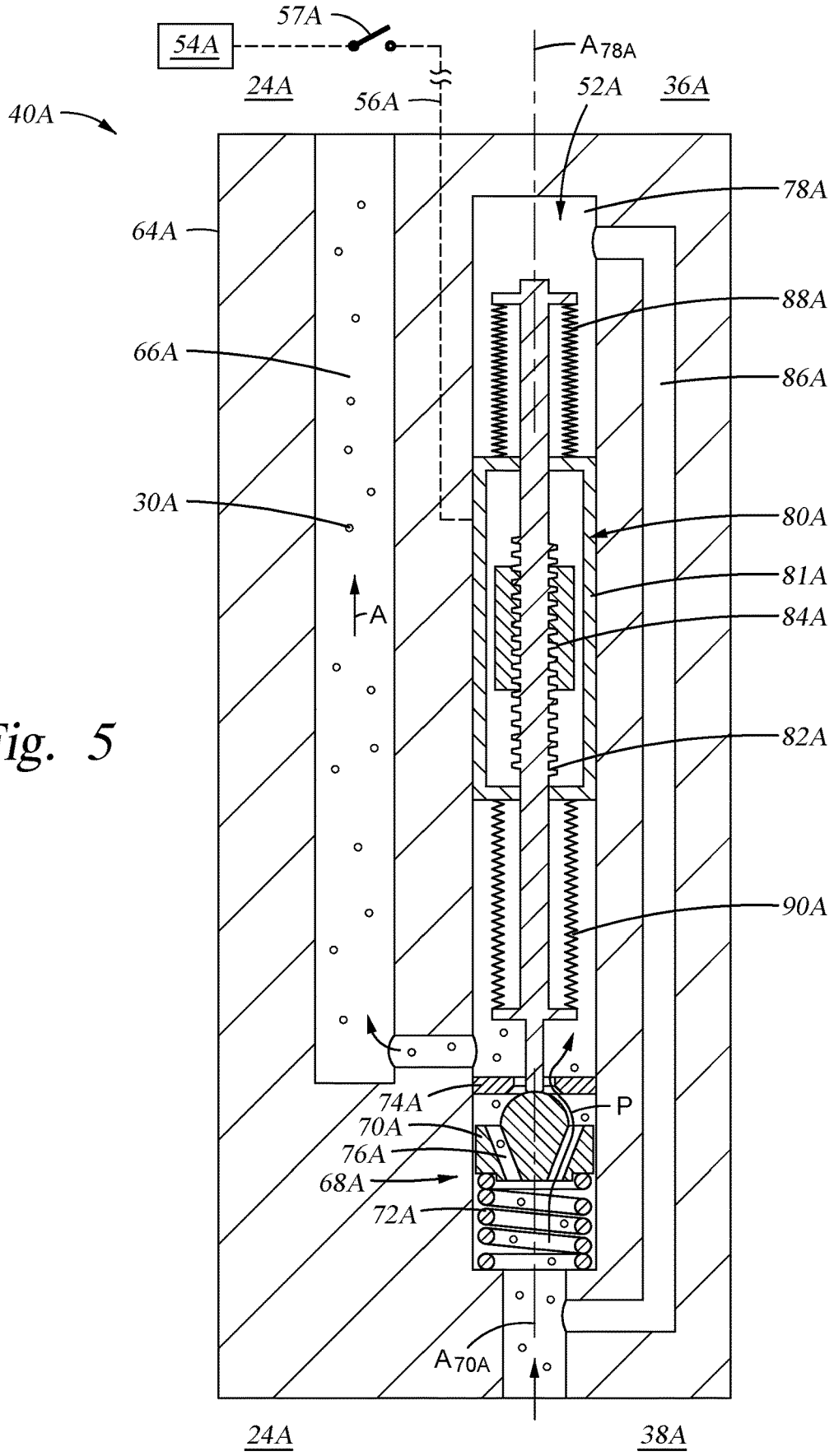
FIG. 5 is a side partial sectional view of an example of an annulus safety valve for use with the well of FIG. 1 and in a venting configuration.

Referring now to FIG. 5, shown is a non-limiting example of venting of the lower portion 38A of annulus 24A. In this example, shaft 82A is extended from actuator 52A into contact with valve member 70A; shaft 82A is further extended to urge the valve member 70A away from valve seat 74A and as described above configures the annulus safety valve 40A (and the check valve assembly 68A) into an open position. The shaft 82A as shown is in interfering contract with the valve member 70A and prevents the valve member 70A from being in contact with the seat 74A. In the example shown, motor 80A (which is part of actuator 52A) receives power from power source 54A via cable 56A. Motor 80A of FIG. 5 (alternatives of which include a series of windings (not shown) and permanent magnets) converts electrical energy to mechanical energy for extending shaft 82A to reposition the valve member 70A away from valve seat 74A and compress spring 72A. For the purposes of discussion herein, when the shaft 82A is extended from the motor 80A as shown in FIG. 5 and as described above, actuator 52A is in a deployed configuration or deployed operational state. When the shaft 82A is spaced away from the check valve assembly 68A and as shown in FIGS. 3 and 4, actuator 52A in a retracted configuration or retracted operational state. As explained above, power is supplied to the actuator 52A in the form of electricity from the power source 54A for reconfiguring the actuator 52A between the deployed and retracted configurations.

In an example of venting, pressure in the lower portion 38A exceeds pressure in upper portion 36A; which as described above and without the intervention of actuator 52A, check valve assembly 68A would be in a closed position (FIG. 4) and blocking communication between lower portion 38A and upper portion 36A through the annulus safety valve 40A. In the example of FIG. 5, because of the bistable nature of actuator 52A, the actuator 52A remains in a deployed configuration and/or in a retracted configuration while unpowered and without receiving electricity from power source 54A or any other power source (not shown); including power sources that provide power other than electrical, such as hydraulic or pneumatic. In the illustrated example, switch 57A in cable 56A is shown in an open state, which isolates the actuator 52A from the power source 54A; in this example actuator 52A is unpowered while remaining in its deployed configuration, and continues to keep check valve assembly 68 in its open position. This feature provides an advantage over known safety valves that require continuous power to remain in an open position. In embodiments, command signals from controller 48 (FIG. 1) are transmitted to one or more of actuator 52A, switch 57A, and power source 56A that initiate and control operation of these devices to reconfigure actuator 52A between its deployed and retracted configurations, and to maintain the actuator 52A in either of these operational states. In examples, transitory or non-transitory control logic or instructions stored in readable media are used for determining the timing and particular command signal generated and transmitted by controller 48. Alternatives exist in which controller 48 or a surface monitoring package (not shown) is employed for pass/fail or integrity tests of the annulus safety valve 40A, and which can be automated.

Further shown in the example actuator 52A of FIG. 3-5 is a bypass line 86A that provides communication between passage 66A downhole of check valve assembly 68A and a portion of chamber 78A opposite from the end of shaft 82A that contacts check valve assembly 68A. Also shown are bellows 88A, 90A that cover portions of shaft 82A on opposing sides of housing 81A. The bypass line 86A in combination with bellows 88, 98A provide pressure balancing on the actuator 52A to reduce the force necessary for moving shaft 82A when faced with elevated pressures while in the wellbore 12 (FIG. 1.).

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for use with a wellbore comprising:

an annulus defined between tubulars disposed in the wellbore; and an annulus safety valve disposed in the annulus that comprises, a body, a bistable actuator comprising an electrically powered motor and a shaft coupled with the motor, the bistable actuator being selectively changeable between deployed and retracted operational states, and a check valve comprising a valve member, a valve seat, and a spring biasing the valve member against the seat, the check valve being maintained in an open position by interfering contact with the shaft when the bistable actuator is in the deployed operational state, and the check valve in a closed position when the actuator is in the retracted operational state and the shaft is spaced away from the check valve.

2. The system of claim 1, wherein when the shaft is in interfering contact with the check valve assembly, the valve member is spaced away from the valve seat to define a path for fluid flow between the valve seat and the valve member.

3. The system of claim 2, further comprising ports formed through the valve member, and wherein the path extends through the ports.

4. The system of claim 1, wherein the annulus comprises upper and lower portions that are adjacent one another, and wherein the upper and lower portions are in communication when the check valve is the open position, and wherein the upper and lower portions are isolated from one another when the check valve is in the closed position.

5. The system of claim 4, wherein the check valve is disposed in a passage that is formed through the body, and wherein opposing terminal ends of the passage are respectively in communication with the upper and lower portions.

6. The system of claim 4, wherein the check valve is moved into the open position when pressure in the upper portion exceeds pressure in the lower portion by a designated amount.

7. The system of claim 1, wherein the actuator is in communication with an electrical source when changing to the deployed configuration, and wherein the actuator is out of communication with the electrical source while remaining in the deployed configuration.

8. The system of claim 1, wherein the tubulars comprise casing lining the wellbore and production tubing inside the casing, the system further comprising a wellhead assembly mounted over an opening to the wellbore, a source of lift gas in communication with the annulus through the wellhead assembly, wherein lift gas is selectively injected into the tubing through lift gas valves that are coupled to the tubing.

9. The system of claim 8, wherein lift gas flows through the check valve when the check valve is in the open position.

10. A method of operating a wellbore comprising:

handling lift gas in an annulus of the wellbore in which an annulus safety valve is disposed and that comprises a body, a passage in the body, a check valve in the passage that comprises a spring and a valve member, the spring biasing the valve member against a valve seat to automatically put the check valve into a closed position when pressure downhole of the check valve exceeds pressure uphole of the check valve, and an actuator;

venting from the wellbore by providing a supply of electricity to the actuator to change the actuator from a retracted configuration to a deployed configuration which biases the check valve into an open position;

reconfiguring the actuator from the deployed operational configuration to the retracted operational configuration by energizing the actuator, removing the supply of electricity to the actuator; and maintaining the actuator in the deployed configuration while the actuator is isolated from a power source.

11. The method of claim 10, further comprising injecting lift gas into the wellbore at a pressure which maintains the check valve in the open position and lift gas flows from uphole of the check valve to downhole of the check valve.

12. The method of claim 10, wherein the step of venting comprises removing lift gas from the wellbore.

* * * * *